US005393156A

United States Patent [19]

Mullin et al.

[11] Patent Number: 5,393,156

[45] Date of Patent: Feb. 28, 1995

[54] MOLDED BINDER ASSEMBLY

[75] Inventors: Howard R. Mullin, Atherton; Peter D. Doninelli, Morgan Hill, both of Calif.

[73] Assignee: Duo-Tang, Inc., Paw Paw, Mich.

[21] Appl. No.: 193,234

[22] Filed: Feb. 8, 1994

[51] Int. Cl.[6] ..... B42F 3/04

[52] U.S. Cl. ..... 402/36; 402/31; 402/38; 402/41

[58] Field of Search ..... 402/26, 31, 36, 37, 402/38, 39, 41, 42, 44

[56] References Cited

U.S. PATENT DOCUMENTS

| | | | |
|---|---|---|---|
| 710,364 | 9/1902 | Maloney | 402/36 X |
| 1,499,294 | 6/1924 | Costello | 402/36 |
| 2,129,109 | 9/1938 | Unger | 402/36 |
| 2,572,305 | 10/1951 | Bloore | 402/36 |
| 3,348,550 | 10/1967 | Wolf et al. | 402/38 X |

FOREIGN PATENT DOCUMENTS

| | | | |
|---|---|---|---|
| 1104022 | 2/1968 | United Kingdom | 402/36 |

*Primary Examiner*—Willmon Fridie
*Attorney, Agent, or Firm*—Douglas A. Chaikin

[57] ABSTRACT

Disclosed herein is a molded locking snap ring assembly for use in holding looseleaf sheets together as in a two or three-ring binder. The assembly is preferably a one-piece molded construction including an elongated longitudinal base section having upright retaining levers at each end, extending between two pivotally opposed ring support sections. Integral reduced cross section hinge sections joining the base and ring sections provide pivotal connection therein. The ring sections carry opposed ring segments for movement toward and away from one another into closed and open positions respectively. Integrally molded locking arms mounted at each end of the ring support sections carry free ends having oblique surfaces for contacting and pushing respective levers outward and projecting ledges having latching surfaces for latching with central channels defined in the levers. Offset ends of separated ring segment pairs and torsional spring members therebetween included in the ring sections provide tension to hold latching ledges in locked position in the latching channels.

12 Claims, 4 Drawing Sheets

MOLDED BINDER ASSEMBLY

BACKGROUND OF THE INVENTION

1. Field of the Invention

The invention relates to a snap ring assembly for carrying punched papers and more particularly to one-piece molded locking hinge binders.

2. Previous Art

A number of binder assemblies have been developed for holding looseleaf papers together. Commonly, these are two, three or more ring looseleaf notebooks and binders utilizing such snap ring assemblies. Binders for English and Metric papers of idfferent sizes, spacings and ring hole counts are common, i.e., English size A and Metric A4 paper. Generally, the snap rings are two or more sets of spaced apart ring pairs that are in substantial registration with each other. The ring pairs can be pivoted from an open condition toward each other and at some predetermined position, are caused to mate together to provide a closed and locked position. The typical binder relies upon a spring-like mechanism to normally urge the ring pairs together in the lock position.

The Papers which are stored in the binder typically include perforated holes along one side that are positioned so that the papers are compatible with and stored by the ring pairs before the ring pairs are pivoted into the closed and locked position. Traditionally, such binder ring pairs have been made from metal. In recent years there has been a move to make such ring pairs from molded plastic polymer.

An example of a typical three ring binder is disclosed in Doffman U.S. Pat. No. 3,995,961. Doffman discloses a binder which includes an integral thermoplastic hollow spline. The spline has three pair of ring halves. One half of each pair is formed as part of movable leaf segments. The leaf segments are integrally connected by scored folding lines to spaced apart walls forming upright edges of the base segment. The folding lines allow pivoting movement for the leaf segments away from and toward the base. The leaf segments are connected to each other by a third folding line. The folding lines allow the leaf segments to move into one of two different rest positions. The first position is with the ring halves open and the third folding line above the upright base edges. The second position is with the ring halves closed and the third folding line below the upright base edges.

One disadvantage with this structure is that it can not be extruded from a mold in the longitudinal direction. Post molding treatment is required due to the presence of projecting ring halves and the closed spine. The mold tooling and process required to accommodate the hollow spline and integral ring halves in a one piece assembly would result in longer cycle times and relatively low productivity.

A disadvantage of the type of structure shown in '961 is that the closure of the rings is secured only by the spring action of the base and upright base sidewalls pressing on the short lever arm formed by the side walls. No positive locking mechanism is provided as part of a one piece assembly in this structure.

Another disadvantage of the hollow spline binders type is that they require more material per unit length than binders of simpler cross-section and thus increase the cost of manufacture.

Another molded binder having side walls and base section with hinged leaf sections is disclosed by Vanni, U.S. Pat. No. 5,018,896. Vanni discloses an elongated base portion extending between separate sidewalls. The sidewalls include respective proximate sections and distal sections having free ends which snap together in the closed position. Closure is maintained by the elastic tension of the sidewalls pressing inward on the distal sections. Vanni teaches that the distal ends of the leaf sections are not integrally connected, but are configured to matingly engage when swung together about the hinge sections. Engagement of the two leaf sections is provided by cooperating male-female configurations such as lip or tongue and groove or channel along the free end of the distal end of the leaf sections. One disadvantage of this method of closure is that it requires additional care by the user in aligning the distal ends of the leaf sections to ensure proper engagement of the opposed tongue and groove configuration.

Vanni also discloses a lock pivotally mounted on one side of a leaf section. The lock is not shown or described but appears to be separate from the end of the assembly. The lock disclosed has a pin which engages a detent on the opposite distal leaf section in a closed position. The detent is a concave depression having a deep re-entrant shape which is difficult to mold with a simple single parting line mold. The locking effectiveness depends on the depth of engagement, and the thickness and strength of material. Under sufficient pull on the rings, the locking arm will flex, the pin will slide and slip out of the detent. There is no positive locking mechanism disclosed which can be molded as part of the one piece assembly.

The closed condition taught by Vanni and Doffman is not provided by a positive locking mechanism but depends on the spring strength of the structure. Thus, a sufficient load of paper or inadvertent shock could cause the rings to spring open with a resulting loss of papers and possible damage.

Both Vanni and Doffman rely on over center motion of the leaf sections and spring action of the flexing outer wall of the sides of the base section. Both disclosures rely on spring action to keep the rings closed.

The design of the assemblies disclosed in Vanni, '896 and Doffman, '961 have re-entrant surfaces which would require other post-molding processes or require molds having slides to accommodate the complex shapes disclosed.

It is desirable to provide a one piece binder that minimizes re-entrant shapes with significant inward angles and does not require post molding treatment or complex molding tooling. It would also be an advantage to provide a binder having a self aligned positive locking member integrally formed as part of the assembly. There is also a need for a more positive locking mechanism not solely dependent on spring force. It is also desirable to provide a binder which provides a simple mechanism for locking and releasing the paper anchoring rings which requires minimal additional manual manipulation.

SUMMARY OF THE INVENTION

It is an object of the invention to provide a one-piece molded locking snap ring binder assembly for holding loose leaf sheets which has an integral positive latching mechanism requiring minimal manual manipulation.

It is a further object of the invention to provide a binder assembly having a positive locking mechanism which can be molded in a one-piece operation.

It is a further object of the invention to provide a binder assembly with a shape minimizing vertical re-entrant surfaces thereby permitting it to be molded in a single splitting line mold.

In accordance with the above objects and those that will be mentioned and will become apparent below, the molded locking binder snap ring assembly of the present invention comprises:

an elongated longitudinal base section having a top, a bottom, lateral sides and opposed ends;

two ring support sections having proximal and distal sides and opposed ends;

hinge means, connected between the proximal side of each ring support section and the corresponding lateral side of the base section, for pivoting the ring support sections to and away from the base section;

a plurality of opposed pairs of spaced apart ring segments for retaining the loose leaf paper, the pairs of segments mounted on the respective ring support sections, the segments spaced apart from the ends of the support sections, the pairs of segments having free ends, the opposed pairs of segments substantially aligned and configured to make contact at the respective free ends to form fully closed rings when the support sections are pivoted into a closed position;

engagement members for engaging the ring sections and the base section, releasably connected between the ring support sections and the base section, for releasably locking the support sections to the base section in the closed position, whereby the loose leaf sheets retained by the ring segments may be retained, added to or subtracted from as desired.

The engagment members of the preferred embodiment include a lever connected to one end of the base section. The lever includes two opposed side members forming the connection to the base section end. The side members define a channel opening therebetween. The side members include resilient sections which provide support and restoring force for pivotal motion of the lever toward and away from the top of the base section.

The engagement members of the preferred embodiment include locking arms molded as part of the ends of the ring support sections The locking arms include free ends having oblique angled faces. The angled surfaces are configured for sliding on the outside edges of the inward facing surfaces of adjacent levers such that the levers will be rotated outward away from the base section as the respective ring sections and locking arms are pivoted from an open position about the hinge sections connecting the ring sections and the base sections toward a closed position.

The free ends of the locking arms also include outward facing ledges proximal to the angled faces which form latching members for engaging the adjacent lever. The channel opening of the respective lever is configured to provide a suitably angled latching surface for the respective projecting ledge when the ring sections are in a closed position.

In another preferred embodiment of the snap ring assembly in accordance with this invention, the face contacts the lever at an angle of about 45 degrees at a first partially closed position of the pivotally hinged ring support sections.

In another preferred embodiment of the snap ring assembly in accordance with this invention, the respective ledge is configured for latching in the channel of the respective lever at an acute angle $\alpha$ of about 10 degrees.

In a preferred embodiment of the snap ring assembly, each locking arm is configured such that, when the respective lever is rotated a suitable amount outward relative to the base, the arm will be released from a latched condition with the lever and channel opening, whereby the ring support sections are free to pivot open thereby opening the ring segments.

In a preferred embodiment of the snap ring assembly, at least one set of ring pairs distal from the engagement members is configured to form a first fully closed ring at a second partially closed position before a second set of ring pairs proximal to the engagement members forms a second fully closed ring, and before the engagement members form a fully locked and closed position between the ring support sections and the base section whereby the respective free ends of the proximal and distal segment pairs are offset.

The sets of ring segment pairs provide the means for anchoring punched paper when the rings are closed and locked by the locking mechanism.

In a preferred embodiment of the snap ring assembly, the ring support sections include a first set of torsion members between the distal set and proximal set of ring pairs, and a second set of torsion members between the proximal set of ring pairs and the engagement members, whereby the first and second torsion members provide restoring force for separating the segments of the ring pairs when the engagement member is released.

The first set of torsion members between the distal and proximal ring pairs, and the second set of torsion members between the proximal ring pairs and the engagement members, provide torsional tension tending to keep the latching ledge engaged with the channel when the ring sections are in a closed position.

A preferred embodiment also includes at least one opening in the base section from top to bottom that is configured to enable a preselected fastener to extend therethrough and secure the assembly to a substrate.

In a preferred embodiment of the molded snap ring assembly of the present invention, the hinge means include a plurality of slots therethrough wherein the location and length of the slots are apportioned to provide suitable tactile sensation for the user during opening and closing of the ring support sections. The location and length of the slots are also apportioned to provide suitable torsional characteristics to the ring support sections between the respective ring segment sets and the engaging arm means.

A preferred embodiment is shaped such that the assembly can be molded as one piece from a single parting line mold.

The configuration of the lever and channel openings provides surfaces which are easily molded in a single parting line mold. The lever and channel openings are comprised of simple planes which are projections of purely horizontal or vertical surfaces. The locking arms and ledges and the ring sections and hinge openings are also composed of simple shapes which are projections of either purely horizontal or vertical surfaces.

The angle and shape of the surfaces comprising the locking binder of this invention are arranged to avoid or minimize the use of angles re-entrant from the vertical with respect to the base section.

These features allow the locking binder assembly of the present invention to be molded from a single parting line mold with simple vertical steps between adjacent surfaces.

No post molding operations are required to manufacture the locking snap ring binder of the present invention thus keeping manufacturing cost low.

The locking arm and lever provide a positive locking mechanism not dependent on spring force to hold it closed and thereby less subject to inadvertent release.

The locking snap ring binder provided by this invention eliminates the dependence of the locking effectiveness on the spring force of the binder. The strength of the locking mechanism is determined by the size and ultimate yield strength of the material chosen rather than the elastic properties of the material.

The difference in position of the contact points of the first and second set of ring segments creates torsional restoring forces within the ring support torsional spring members. These torsional restoring forces act to keep the locking arm ledges in latched contact within the arm channels. This ensures positive locking action against ring opening that is limited only by the cross section and ultimate strength of materials of the arms and ledges and the overlap of the ledges in the channels.

The alignment of the locking means of this invention during closure of the rings is predetermined by the structure of the lever and locking arms and does not require any particular intervention on the part of the user but is a natural consequence of closing the binder rings.

The offset of the ends of the proximal and distal ring segment sets and the use of the torsion spring nature of the ring support sections between the ring sets and between the rings and the engagement members of the binder tends to keep the locking mechanism engaged but does not determine the locking force. The torsion members also provide a force for conveniently opening the ring segments when the lever releases the locking arm.

The first set of ring segments is separated from a second set of ring segments by the ring support section torsion members. The first set of ring segments is configured to make contact with the respective segment of the opposite section prior to the occurrence of a latched condition of the locking arms and levers. The second set of the remaining ring segment pairs is configured to make contact after the contact of the first pair but before the occurrence of the latched condition of the locking arms and levers. This ensures a fully closed set of ring pairs for holding looseleaf sheets that are guaranteed to remain locked.

It is an advantage in accordance with this invention to provide a molded locking ring binder with a locking mechanism that does not depend solely on spring tension of one of the elements.

It is further an advantage in accordance with this invention to provide a positive locking ring binder that can be molded in a one-piece operation.

It is a further advantage in accordance with this invention to provide a self aligning positive locking mechanism.

BRIEF DESCRIPTION OF THE DRAWINGS

For a further understanding of the objects and advantages of the present invention, reference should be had to the following detailed description, taken in conjunction with the accompanying drawings, in which like parts are given like reference numerals and wherein.

DETAILED DESCRIPTION OF A PREFERRED EMBODIMENT OF THE INVENTION

Figure 1:
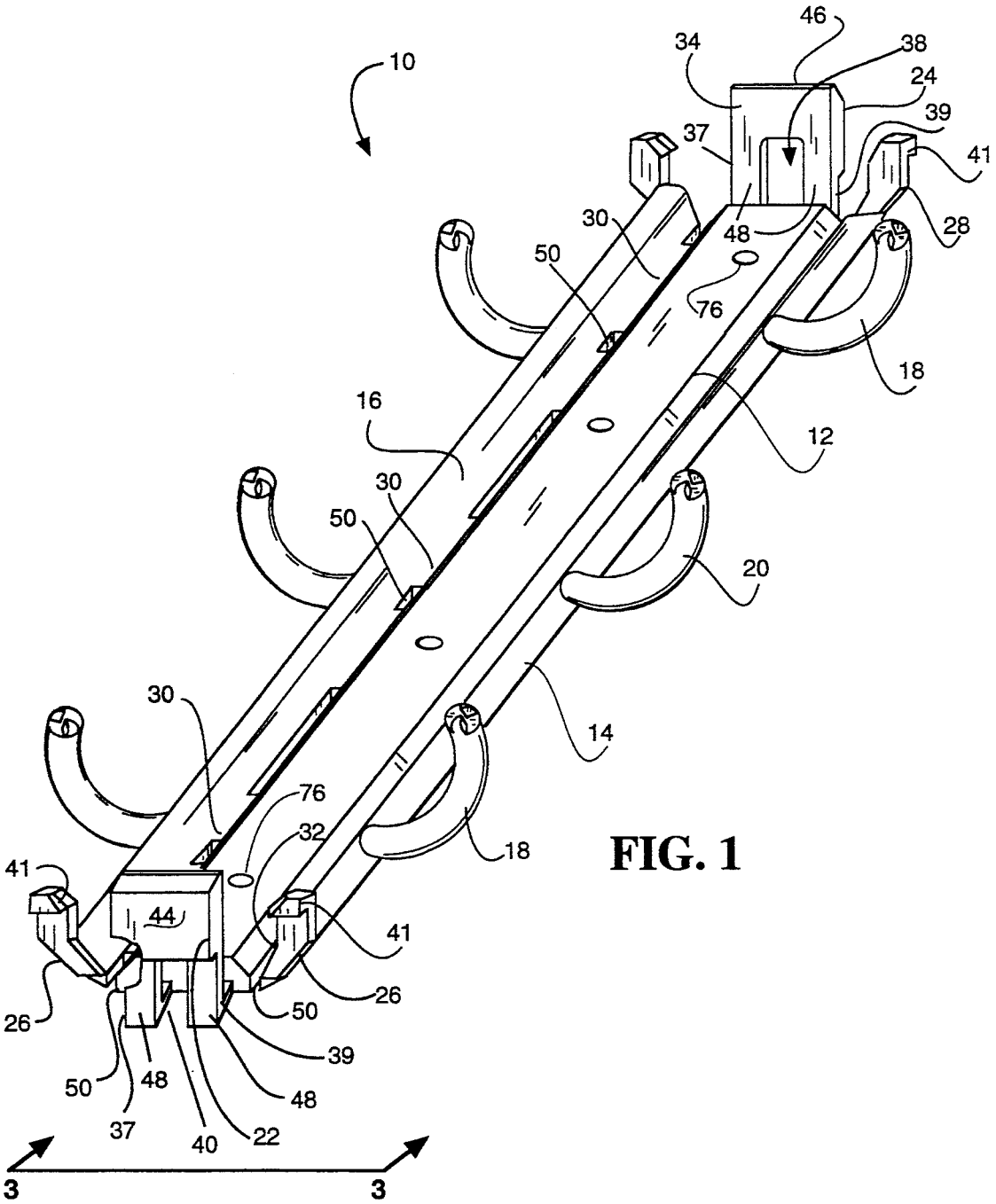
FIG. 1 is a perspective view of a one-piece snap ring assembly in accordance with this invention in a fully open position.

With reference to FIG. 1, there is shown a preferred embodiment of the binder in accordance with the invention, generally indicated by the numeral 10. The binder 10 is shown in an open position.

The binder 10 includes an elongated, generally rectangular base section 12 having lateral sides and opposed ends. The base section 12 is joined to a pair of integral ring support sections 14 and 16. The support sections 14 and 16 include sets of matching integral outer half ring segments 18 proximal to the base section 12 ends. and integral inner half ring segments 20 distal from the base section 12 ends. The sections 14 and 16 include integral inner half ring segments 20 distal from the base section 12 ends. The base section 12 is integrally joined longitudinally along each lateral base section edge to the respective support sections 14 and 16 by respective integral hinge sections 30 and 32. Hinge section 32 is hidden in FIG. 1 by ring section 14. The support sections 14, 16 pivot toward and away from each other and the base 12 around the hinge sections 30, 32.

In a preferred embodiment in accordance with this invention, the base section 12 is provided with a plurality of spaced apart openings 76. The openings 76 are configured to enable a preselected fastener to be received therethrough for securing the assembly 10 to a selected substrate (not shown) such as a looseleaf binder cover.

The ring segments 18 and 20 project transversely and inwardly with respect to base section 12. One of the outer ring segments 18 is proximal to each end of the respective ring sections 14, 16. One of the inner ring segments 20 is located in the center of each of the respective support section 14, 16. The ring segments 18, 20 are mounted in substantial registration with corresponding segments of the opposed ring support section. The inner ring segments 20 are thereby connected to the outer ring segments 18 by the ring support sections 14 and 16.

Figure 2:
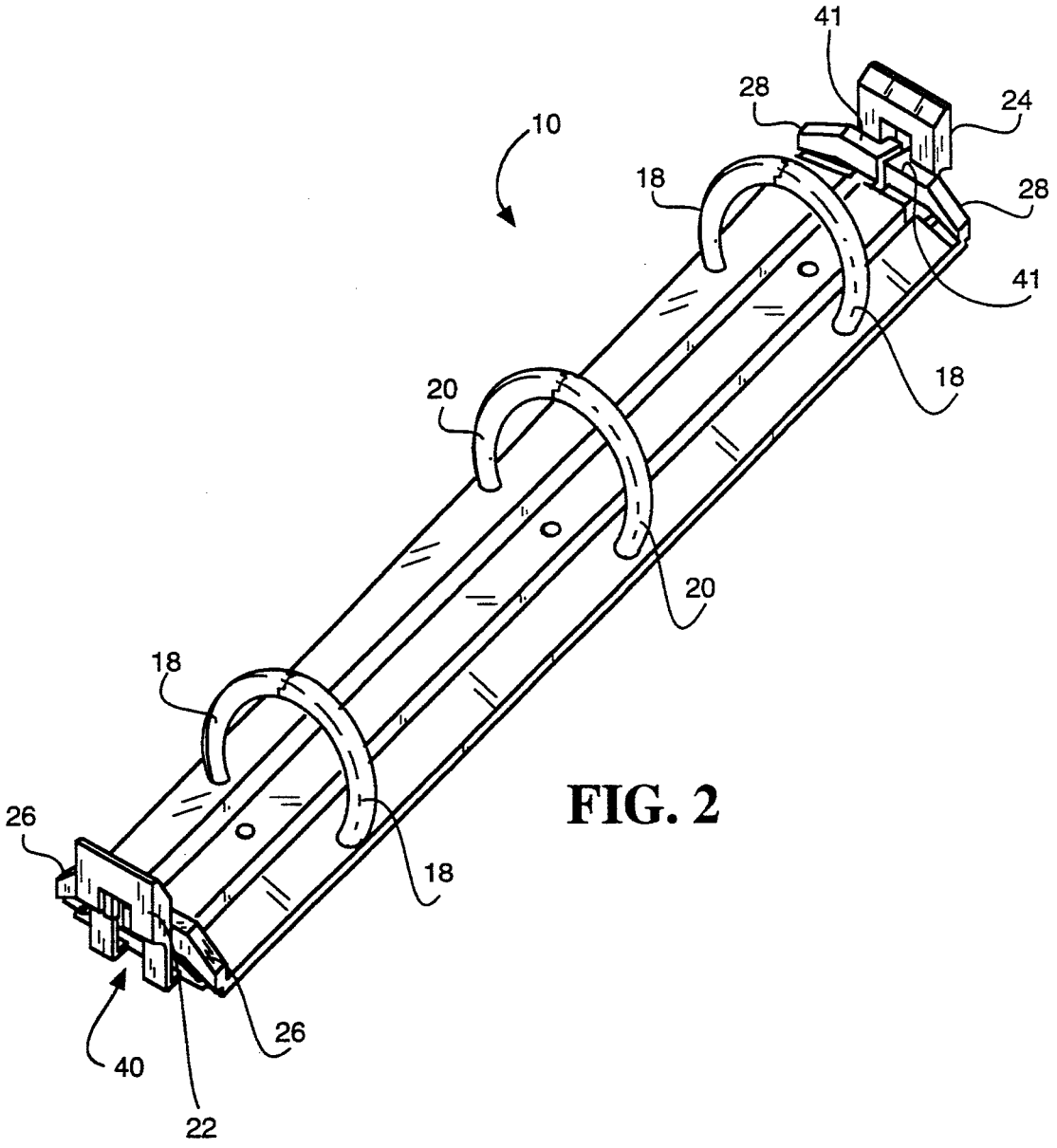
FIG. 2 is a perspective view of a one-piece snap ring assembly in accordance with this invention in a fully closed position.

With regard to FIG. 2, the binder 10 is shown in the fully closed position. The segments 18, 20 form respective inner and outer continuous circular rings for retaining looseleaf sheets.

The base section 12 has integrally formed first retaining lever 22 at one end and second retaining lever 24 at the opposite end. The levers 22, 24 extend upwardly in a rest position at essentially right angles from each respective end of base 12.

Pairs of locking arms 26 and 28 are molded to the respective ends of support sections 14 and 16. The arms 26 and 28 have engagement members 41 disposed at the free ends of the arms which are partially hidden at one end of binder 10 in FIG. 2.

Retaining levers 22 and 24 have inward facing inner surfaces 34, 36. The levers 22 and 24 with outside surfaces 68 and edges 70 for cooperating with the engagement members 41 of the locking arms 26 and 28 as will be described below.

The levers 22, 24 have respective centrally located channels 38 and 40 defined by lever side members 37, 39. The channels 38 and 40 cooperate with the engagement members 41 of the latching arms 26, 28. The channel openings 38 and 40 in the levers 22 and 24 define vertical latching surfaces 42 on each inner side of the channels 38, 40. The latching surfaces 42 are oriented longitudinally with respect to the base 12. The channels 38 and 40 are open at the bottom. The channels 38 and 40 begin at a point near the connection of the respective levers 22, 24 with the base 12 and extend upward toward the end of levers 22, 24.

The binder 10 includes end cross pieces 44, 46 connecting the side members 37 and 39. The cross pieces 44 and 46 are integral with the base 12 and terminate the respective channels 38, 40. The cross pieces 44 and 46 form the end of the respective levers 22, 24 and cause the side members 37 and 39 of the respective levers 22, 24 to move together. The side members 37 and 39 include resilient sections 48. The sections 48 extend from the end of the base 12 and project upward along the levers 22, 24 to a point intermediate from the base 12 and the end of the levers 44, 46. The sections 48 are formed having a cross section which is thin relative to the balance of the levers 22, 24 and end pieces 44, 46. The thickness and extent of the sections 48 are suitably sized to form resilient spring-like members. The sections 48 provide support and restoring force to return the levers 22, 24 to rest position after outward deflection.

The integral hinge sections 30, 32 between the base 12 and the support sections 14, 16 are generally formed by molding the assembly 10 from a suitable flexible polymer. The hinge sections 30, 32 provide a rotatable connection between the base 12 and the support sections 14, 16.

A preferred embodiment of binder 10 is molded from polypropelene, coined nylon, or polyester. These materials exhibit the desired characteristics of flexibility, strength, elasticity and resistance to flex fatigue which are suitable for binders having living hinges.

The distal edges of the ring support sections 14, 16 may pivot away from and toward each other about the hinge sections 30, 32 respectively as described above.

The rotatable connections between the base 12 and the ring support sections 14, 16 may also be made of other flexible structures. A hinge may be formed of a segmented series of longitudinal strips wherein each of the connections between the strips flex a small amount. The material, the number of segments and the total flexing angle may be chosen such that the stress on the hinge material is below the yield point of the hinge material.

A plurality of slots 50 is provided in the hinge sections 30 and 32. The slots 50 are sized and located along the length of the sections 30 and 32 to give suitable strength and flexibility for the hinges. In a preferred embodiment of this invention, the slots 50 comprise about 50% of the length of the hinges 30 and 32. The proportions of slot length and location are chosen to give suitable characteristics to the feel and function of the hinges for different materials and choices of hinge dimensions.

Figure 3:
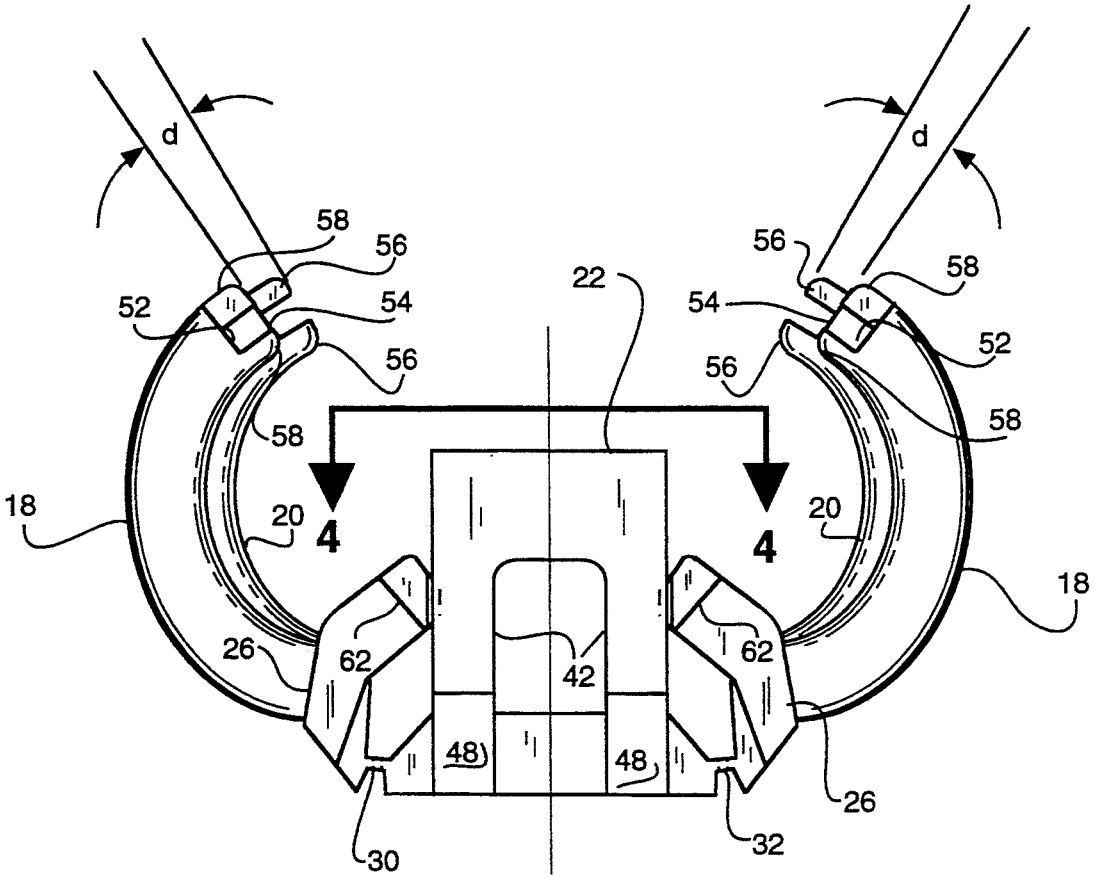
FIG. 3 is a cross sectional view taken across view line 3—3 of FIG. 1 in a first partially closed position in accordance with this invention.

With respect to FIG. 3, there is shown the the hinge sections 30, 32 having reduced thickness relative to the base section 12 and support sections 14, 16. The hinge sections 30, 32 have a thickness normal to the hinge surface of about 3–15 mils with a preferred thickness of about 10 mils. The hinge sections 30 and 32 have a lateral extent between the base 12 and the sections 14, 16 in the range of about 50 to about 200 mils. A preferred value is about 100 mils for a binder 10 made of polypropolene.

With reference to FIG. 3, there is shown the ring segments sets 18 and 20 having faces 52 and 54 at the respective free ends. The faces 52 and 54 have matching bifurcated projections 56 and 58 which engage when the ring segments 18 and 20 are closed. The projections 56 and 58 are sized and configured to account for molding tolerances. The projections 56 and 58 also guide and hold the ring segments into a secure closed configuration reducing the tendency of the segments 18 and 20 to come open due to inadvertent lateral forces.

The engagement memembers 41 of the locking arms 26 and 28 is shown engaged in the channels 38 and 40 to form a positively locked, positively closed condition.

Figure 4:
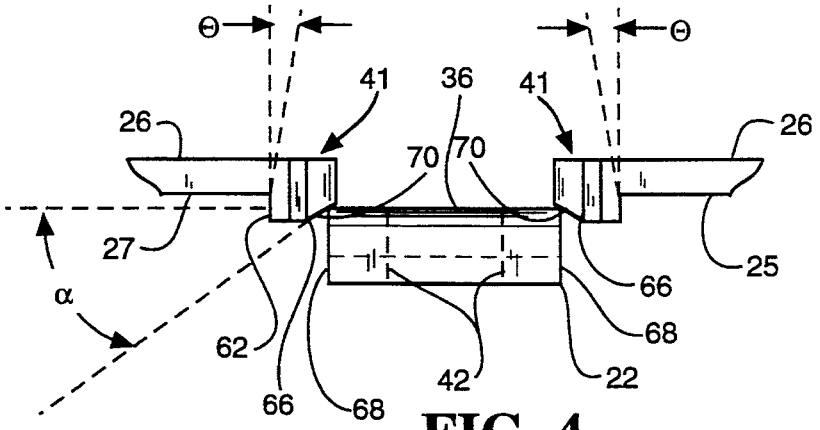
FIG.4 is a cross sectional view taken across view line 4—4 of FIG. 3 in accordance with this invention

With reference to FIGS. 3 & 4, the configuration and function of the engagement member 41 will now be described with respect to one end of the binder 10. The engagement member 41 of each arm 26 includes an inverted projecting ledge 62 which faces outward with respect to the base 12 and the levers 22 and 24. A face 66 is disposed between the ledge 62 and the free end of each arm 26. The face 66 is configured to be oriented at an oblique angle $\alpha$ relative to the respective lateral face 68 and face 36 of the lever 22 when the face 66 of the arm 26 contacts the lever 22 at edge 70.

Pivotal motion of the ring support sections 14 and 16 cause the face 66 to push the lever 22 pivotally away from the base 12. Further pivotal movement of the sections 14 and 16 cause the extreme ends 64 of the ledges 62 to slide inward along the inner face 36 of the lever 22. For a preferred embodiment of the binder 10, the angle $\alpha$ is about 45 degrees.

The free ends of the opposed ring segments 18 and 20 also approach each other as the support sections 14 and 16 are pivoted inward. The free ends of the inner ring segments 20 are disposed to be offset inwardly by a circumferential distance d from the free ends of the outer segments 18.

With respect to FIG. 4, another aspect of this invention will now be described. In this description reference is made to the inner surfaces 34, levers 22 and the arms 26. The description also applies equally for the surfaces 36, levers 24 and arms 28 at the other end of the binder 10, which are not visible in FIG. 4 but which are equivalent due to symmetry. The projecting ledges 62 of the each of the arms 26 form an acute angle $\theta$ with respective inner surfaces 34 of the levers 22. The angle $\theta$ allows for some deformation of the arms 22 and the ledges 62 due to stress within the arcs 22. The ledges 62 formed without the angle $\theta$ would tend to slide more readily along the inner surgaces 34 under outward stress and allow the rings 18, 20, to come open. In a preferred embodiment, the angle $\theta$ is between about 3 and 8 degrees.

Figure 6:
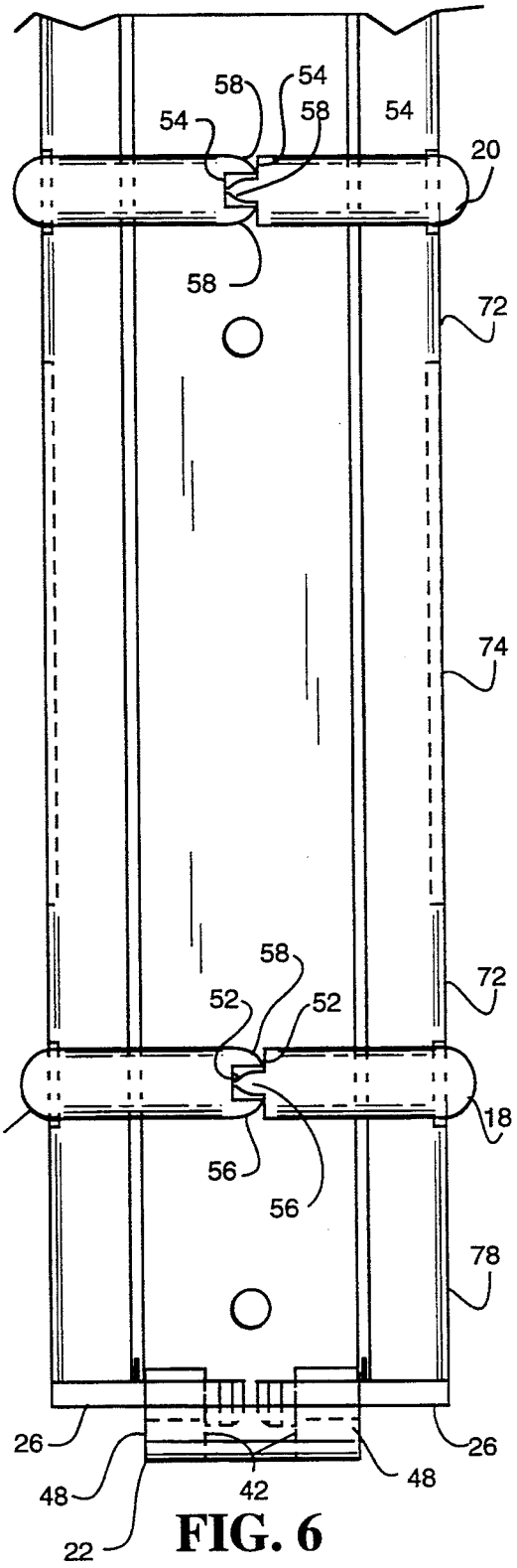
FIG. 6 is a partial plan view of the assembly of FIG. 1 in a fully closed position in accordance with this invention.

In the closed position illustrated in FIG. 2 and FIG. 6, the ledges 62 engaged in respective channels 38, 40 in respective arms 26, 28 form a robust latch against outward rotation of the ring sections 14, 16 due to inadvertent shock or heavy loading on the ring segments 18, 20. Resistance to untoward ring release is limited only by the ultimate strength of the materials and the size of the overlap of the ledges 62 with the arms 26, 28 in the respective channels 38, 40.

Portions 72 and 78 of ring support sections 14, 16 are defined by the adjacent hinge slots 50. The portions 72 and 78 act as torsional spring members between the arms 26, 28 and inner ring segments 20 with respect to rotational motion therebetween. The hinge slots 50 define the regions 72, 78 of essentially torsional resilience. This is contrasted with regions 74 of sections 14, 16 not adjacent to hinge slots 50. The regions 74 include partially cantilever and partially torsional resilience with respect to relative rotation between arms 26, 28, segments 18 and 20.

Further inward rotation of the support sections 14 and 16 at the base of the rings 20 is now constrained by the contact of the free ends of the opposing rings 20. However, further inward rotation of the lever provided by the arms 26 is constrained only by the longitudinal sections 72, 74 and 78 of the ring support sections 14 and 16. The offset distance d between the ends of the inner rings 20 and the outer rings 18 allows further movement of the arms 26.

Further rotation of the arms 26 will cause a twisting of the portions 72, 74 and 78 of the ring support sections 14 and 16 between the inner rings 20 and the arms 26. Portions 72, 74 and 78 now act as torsional springs tending to open the arms 26 away from the lever 22.

Figure 5:
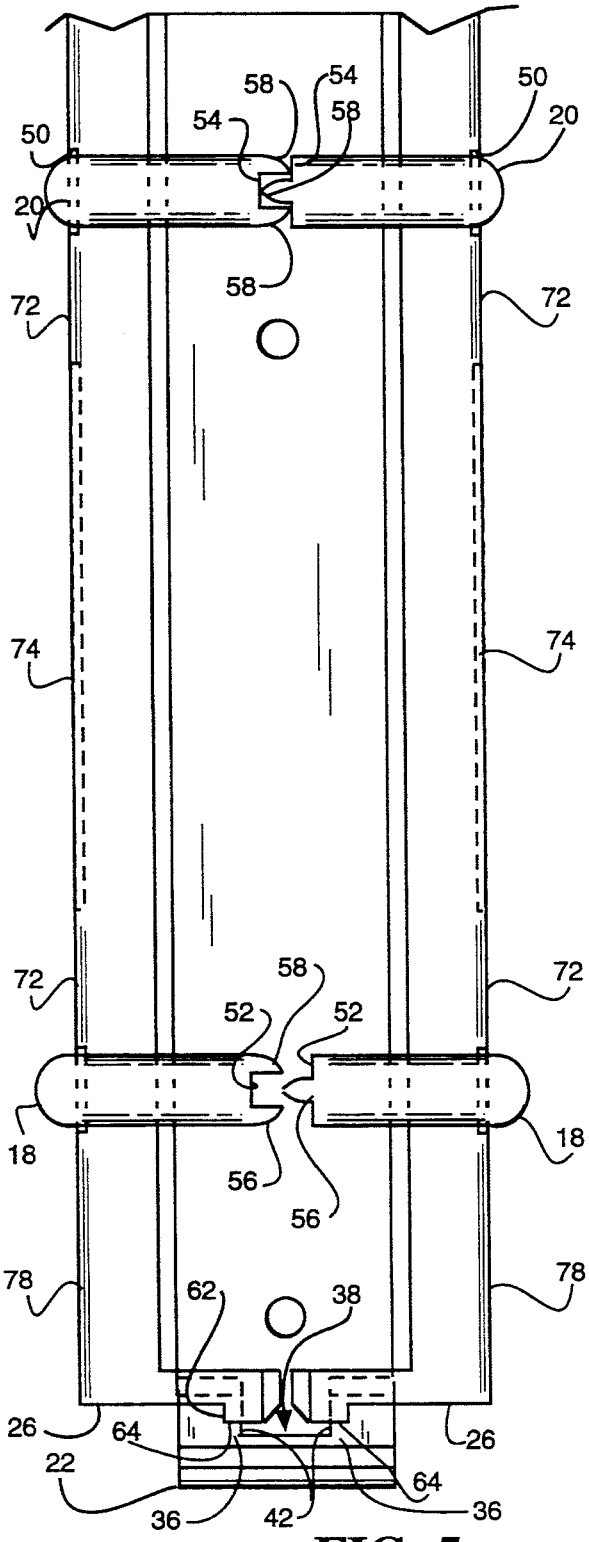
FIG. 5 is a partial plan view of the assembly of FIG. 1 in a second partially closed position in accordance with this invention.

With reference to FIG. 5, the latching ledge 62 is disposed on each arm 26 such that the face 54 and projections 58 of the free end of the corresponding ring 20 make contact with the free end of the opposite ring 20 before the ledge 62 engages into the respective channel 38 and latches with inner surface 42.

Continued pivotal movement of the ring sections 14, 16 cause the arms 26 to pivot inward until the ledges 62 catch into the channel 38 as shown clearly in FIGS. 5 & 6. The resilient sections 48 of the lever 22 will cause the lever 22 to rotate inward and capture the ledge 62 against the surfaces 42 of channel 38. The arms 26 are then locked firmly in place under the torsion of support portions 72, 74 and 78.

The arms 26, 28 and projecting ledges 62 are configured relative to ring segments 18, 20 such that the contact of inner ring faces 54 with the bifurcations 58 of the opposed inner ring segments 20 occurs prior to the latching condition of levers 22, 24 with arms 26, 28 as illustrated in FIG. 5 and as described above. This ensures that a condition of closed ring structure of both the inner ring segments 18 and the outer ring segments 20 exists before the fully latched condition of FIG. 6. Thusly, loose leaf papers inserted in the ring segments 18, 20 are not likely to inadvertently come free as long as a fully latched condition exists.

The locking mechanism provided by this invention is not dependent on spring action to hold the rings closed. The retaining strength of the lock is determined by the cross sectional dimensions and ultimate strength of the materials and not the elastic strength of the materials. Since the ultimate strength of a material is much greater than its elastic limit, the locking capability is improved for a given material and cross section.

The torsional spring constant of the ring support sections 14 and 16 is adjusted by selection of the cross section dimensions of the sections 14 and 16. In addition, the longitudinal placement and size of the slots 50 in the hinges 30 and 32 are selected to provide the desired characteristics of strength and tactile feel to the user.

Three progressive stages of closing the snap ring assembly 10 in accordance with this invention are illustrated with regard to FIG. 3, 4, 5 and 6. In FIG. 3 and 4 the engagement members 41 of assembly 10 are in a first partially closed position after inserting or removing loose leaf sheets. In the first partially closed position the engagement members 41 are in contact with the lever 22. The face 66 contacts the lever 22 at an oblique angle $\alpha$. The face 66 causes the lever 22 to be pushed outward, allowing the arms 26 to rotate further inward.

FIG. 5 shows the engagement members 41 in a second partially closed position. In the second partially closed position the inner rings 20 are in contact, the outer rings 18 are still open and separated by the distance d, and the engagement members 41 are not yet latched with the inner surfaces 42. FIG. 6 shows the rings 18 and 20 and the engagement members 41 in a fully closed and latched condition. Outer ring segments 18 are configured such that the free end faces 52 and outer ring bifurcations 56 of the outer ring segments 18 make contact with opposing bifurcations 56 and faces 52 after respective locking arm ledges 62 pass beyond inner surfaces 42. After ledges 62 pass beyond surfaces 42, the resilient spring sections 48 return levers 22, 24 to their respective rest positions whereby surfaces 42 capture and latch with ledges 62.

Once the ledges 62 are engaged in latching arrangement with the surfaces 42 and the outer ring segments 18 are released, the spring members 72, 74 and 78 tend to twist back and hold the ledges 62 in permanent latched condition with the levers 22, 24.

The alignment and latching of the engagement member 41 with the lever 22 and requires no special effort on the part of the user. The closure of the binder assembly 10 shown in FIGS. 5 and 6 is easily performed by merely pressing inward on the outer ends of the ring sections 14 and 16, preferably on the arms 26. By symmetry, the closure of the other end of the binder is done in the same way.

The binder assembly 10 is opened for removing or inserting sheets by pressing on the levers 22, 24 in an outward longitudinal direction with respect to base 12. With sufficient pressure the levers 22, 24 pivot outward about the resilient lever sections 48 away from the base 12. The inner surface 36 of lever 22 passes the extreme end 64 of arm 26. The ledges 62 then come out of engagement with the channels 38, 40. At this point the ring sections 14 and 16 of binder 10 will be unlatched and te rings 18, 20 open for removal or insertion of paper.

The torsional spring energy stored in the spring members 72, 74 and 78 cause the outer ends of sections 14, 16 and the latching arms 22, 24 to rotate outwardly away from each other and the base 12 about the hinges 30, 32. The ledges 62 will rotate outwardly with resect to the channels 38, 40. The oblique faces 66 will pass outwardly over the edges 70.

The outward directed pressure applied to the levers 22, 24 can be released after the ledges 62 have passed outward beyond the channels 38, 40. After the oblique faces 66 pass outward over the edges 70, the levers 22, 24 will rotate inwardly toward the base 12 under the spring force of the resilient sections 48. The ring segments 18, 20 thereby will be disengaged. The ring segments 18, 20 may be then fully separated by rotating the sections 14, 16 further about the hinges 38, 40 and sheets inserted or removed.

Another aspect of the binder 10 will now be described with reference to FIG. 1 and FIG. 3. The preferred embodiment of locking binder assembly 10 is configured to lend itself well to single parting line plastic molding. The one-piece construction includes the ring sections 18, 30. Particularly, the continuous channels 40 open at the bottom in FIG. 1 and FIG. 3 and the vertical slots 50 and the vertical arms 26, 28 in FIG. 1. The bottom of channel 38 is partially obscured in FIG. 1, but by symmetry is the same as channel 40.

It will be apparent to one skilled in the art of plastic mold design, that the binder assembly 10 in accordance with the present invention is comprised of rectilinear and curved surfaces which can be molded in a stair-stepped, single parting line mold. The top and bottom surfaces of hinge slots 50, the channels 38 and 40, the arms 26, 28 and the engagement members 41 especially are joined together with simple vertical or nearly vertical surfaces.

The ring segments 18 and 20 in the fully open condition are positioned such that the ends of the segments and the bifurcations 56, 58 are nearly vertical. The elastic nature of the polymers used allow the molded part to be removed from top and bottom single parting line mold patterns by simple extraction. Minimizing the use of re-entrant surfaces in the snap ring assembly in accordance with this invention eliminates the use of slide members in such a mold.

While the foregoing detailed description has described the embodiments of the one-piece molded locking snap ring binder in accordance with this invention, it is to be understood that the above description is illustrative only and not limiting of the disclosed invention. It will be appreciated that it would be possible to modify the number of ring segment sets, the shape of the locking arms, the shape of the retaining levers and channel, the shape of the ring support sections, the shapes and type of hinge structure or the number and location of hinge relief slots or to include or exclude various elements within the scope and spirit of this invention. Thus the invention is to be limited only by the claims as set forth below.

What is claimed is:

1. A molded snap ring assembly for holding paper, comprising:

an elongated longitudinal base section having a top, a bottom, lateral sides and opposed ends;

two ring support sections having proximal and distal sides and opposed ends;

hinge means, connected between the proximal side of each ring support section and the corresponding lateral side of the base section, for pivoting the ring support sections to and away from the base section;

a plurality of opposed pairs of spaced apart ring segments for retaining the loose leaf paper, the pairs of segments mounted on the respective ring support sections, the ring segments spaced apart from the ends of the ring support sections, the pairs of ring segments having free ends, the opposed pairs of ring segments substantially aligned and configured to make contact at the respective free ends to form fully closed rings when the ring support sections are pivoted into a closed position;

at least one engagement member for engaging the ring support sections and the base section, releasably connected between the ring support sections and the base section, for releasably locking the ring support sections to the base section in the closed position, each engagement member including at least one lever connected to the base section, and the lever including two opposed side members forming the connection to the base section, the side members defining a channel opening therebetween, the channel opening configured to provide latching surfaces for the engagement member, the side members including resilient sections, the resilient sections providing restoring force for pivotal motion of the lever about the end connected to the base section, whereby the loose leaf sheets retained by the ring segments may be retained, added to or subtracted from as desired.

2. The snap ring assembly as set forth in claim 1, wherein each lever includes an end member connecting the respective lever side members whereby each lever may be pivoted toward and away from the base section by moving the respective end member.

3. The snap ring assembly as set forth in claim 1, having at least one engagement member connected to the respective ring support section for latching in the channel of the nearest respective lever.

4. The snap ring assembly as set forth in claim 3 wherein the engagement member includes an arm having a free end, the other end of the arm mounted to the end of the ring support section.

5. The snap ring assembly as set forth in claim 4, wherein the arm includes a face on the free end, the face configured such that the face slidingly contacts the respective lever at a first partially closed position of the ring support sections, the face angled with respect to the lever such that the lever is forced to pivot away from the arm as the ring support sections are pivoted toward the base section from the open position toward the closed position.

6. The snap ring assembly as set forth in claim 5 wherein the face contacts the lever at an angle of about 45 degrees at a first partially closed position of the pivotally hinged ring support sections.

7. The snap ring assembly as set forth in claim 4 wherein the arm includes a latching ledge projecting from the arm, the ledge configured for latching in the channel of the respective lever at an acute angle $\alpha$ relative to the channel when the ring segment pairs are in the closed position and the lever pivots back to a latched position with the ledge, whereby the possibility of inadvertent release of the ledge from the channel due to distortion caused by stress in the binder is reduced.

8. A molded snap ring assembly as set forth in claim 7 in which the ledge forms an acute angle $\alpha$ relative to the respective channel of between about 3 to 8 degrees.

9. The snap ring assembly as set forth in claim 3 wherein each engagement member is configured such that, when the respective lever is rotated a suitable amount away from the respective arm, the engagement member of the arm will be released from a latched condition with the lever and channel opening, whereby the ring support sections are free to pivot open thereby opening the ring segments.

10. A molded snap ring assembly for holding paper, comprising:

an elongated longitudinal base section having a top, a bottom, lateral sides and opposed ends;

two ring support sections having proximal and distal sides and opposed ends;

hinge means, connected between the proximal side of each ring support section and the corresponding lateral side of the base section, for pivoting the ring support sections to and away from the base section;

a plurality of opposed pairs of spaced apart ring segments for retaining the loose leaf paper, the pairs of segments mounted on the respective ring support sections, the segments spaced apart from the ends of the ring support sections, the pairs of segments having free ends, the opposed pairs of ring segments substantially aligned and configured to make contact at the respective free ends to form fully closed rings when the ring support sections are pivoted into a closed position;

engagement members for engaging the ring support sections and the base section, releasably connected between the ring support sections and the base section, for releasably locking the ring support sections to the base section in the closed position, each engagement member including at least one lever connected to the base section;

a first pair of ring segments distal to one end of the base section and a second pair of ring segments between the distal pair and the one end of the base section being configured to have a first offset circumferential distance between the free ends of the first pair and the free ends of the second pair, and the engagement members being configured such that the second ring segment pair is open a first offset amount, and the engagement member of the respective ring support section of the one end of the base section being displaced from latching in the respective lever by a second offset amount when the ring support sections are pivoted such that the first ring segment pair forms a fully closed ring, and such that the engagement member will latch with the respective lever when the second ring segment pair forms a fully closed ring, whereby the loose leaf sheets retained by the ring segments may be retained, added to or subtracted from as desired.

11. A snap ring assembly as set forth in claim 10, wherein the ring support sections include a first set of torsion members between the first pair of segments and the second pair of segments, and the ring support sections include a second set of torsion members between the second pair of ring segments and the engagement member, whereby the first and second torsion members provide resilient force for holding the engagement member in contact with the lever when the binder is closed.

12. A snap ring assembly as set forth in claim 10, wherein the ring support sections include a first set of torsion members between pairs of ring segments, and the ring support sections include a second set of torsion members between the pairs of ring segments and the engagement member, whereby the torsion members tend to provide resilient force for separating the pairs of ring segments when the engagement member is released.

* * * * *